United States Patent [19]

Pauley

[11] Patent Number: 4,768,239

[45] Date of Patent: Sep. 6, 1988

[54] BATH LIFT DEVICE

[76] Inventor: William E. Pauley, P.O. Box 1688, Shediac, New Brunswick E0A 3G0, Canada

[21] Appl. No.: 102,129

[22] Filed: Sep. 28, 1987

[51] Int. Cl.[4] ..... A47K 3/12

[52] U.S. Cl. ..... 4/564; 4/565; 4/566; 4/575; 4/578

[58] Field of Search ..... 4/564, 565, 566, 575, 4/578, 581, 583

[56] References Cited

U.S. PATENT DOCUMENTS

| | | | |
|---|---|---|---|
| 2,725,578 | 12/1955 | Keller | 4/565 |
| 3,311,930 | 4/1967 | Bourke | 4/566 |
| 3,346,885 | 10/1967 | Merriman | 4/566 |
| 4,419,776 | 12/1983 | Schmidt | 4/565 X |
| 4,495,666 | 1/1985 | Herman, Jr. | 4/565 X |
| 4,557,002 | 12/1985 | Schmidt | 4/565 X |
| 4,574,408 | 3/1986 | Dentler et al. | 4/566 X |
| 4,660,234 | 4/1987 | Schmidt | 4/566 |

*Primary Examiner*—Henry K. Artis

*Attorney, Agent, or Firm*—George A. Seaby

[57] ABSTRACT

A bath lift device for lowering or raising a person in a bathtub includes a planar base for mounting on a bathtub bottom; a parallelogram-type chair structure for laying flat on the base structure or standing on the base in an erect position; an inflatable bag in the chair for raising the chair when filled with water; and slide controlled valves, which can be actuated by the feet of the user, controlling filling and emptying of the bag to raise or lower the chair. The chair includes sides and a back which can be locked together in an erect position, or folded onto the seat of the chair which in turn is folded onto the planar chair-supporting base in the non-use position of the device.

12 Claims, 4 Drawing Sheets

BATH LIFT DEVICE

BACKGROUND OF THE INVENTION

1. Field of the Invention

This invention relates to a bath lift device.

By the expression "bath lift device" is meant a device which can be used to raise or lower a person in a bathtub. It will be appreciated that such a device is intended for use with elderly persons or invalids.

2. Discussion of the Prior Art

Bath lift devices of generally the type described herein are disclosed, for example, by U.S. Pat. Nos. 2,725,578, which issued to J. Keller et al on Dec. 6, 1955; 2,817,096, which issued to J. F. Roth on Dec. 24, 1957; 3,311,930, which issued to T. N. Bourke on Apr. 14, 1967; 3,771,176, which issued to H. H. Herman, Sr. on Nov. 3, 1973; 4,254,577, which issued to H. H. Herman, Jr. on March 10, 1981; 4,419,776, which issued to P. Schmidt on Dec. 13, 1983; 4,495,668, which issued to H. H. Herman, Jr. on Jan. 19, 1985 and 4,534,074, which issued to H. H. Herman, Jr. on Aug. 13, 1985.

While the patented devices perform the same function as the device of the present invention, the patented devices are either too simple, offering limited support for the user and inaccurate control of the lifting or lowering operations, or the devices are unnecessarily complicated and consequently expensive to produce. In view of the foregoing, a need still exists for a simple, efficient bath lift device.

The object of the present invention is to meet the above defined need by providing a relatively simple, inexpensive bath lift device, which offers good user support, and which is relatively easy to control during raising or lowering operations.

GENERAL DESCRIPTION OF THE INVENTION

Accordingly, the present invention relates to a bath lift device comprising planar base means for use on the bottom of a bathtub; chair means hingedly connected to said base means; fluid inflatable bag means in said chair means for inflation to raise the chair to an upper, elevated position and for deflation for lowering the chair to a lower, flat position, first valve means for controlling the flow of fluid to said bag means; second valve means for controlling the discharge of fluid from said valve means; and slide means in said base means for controlling said first and second valve means.

BRIEF DESCRIPTION OF DRAWINGS

The invention will be described in greater detail with reference to the accompanying drawings, which illustrate a preferred embodiment of the invention, and wherein.

DESCRIPTION OF PREFERRED EMBODIMENTS

Figures 1, 2, 3, 4:
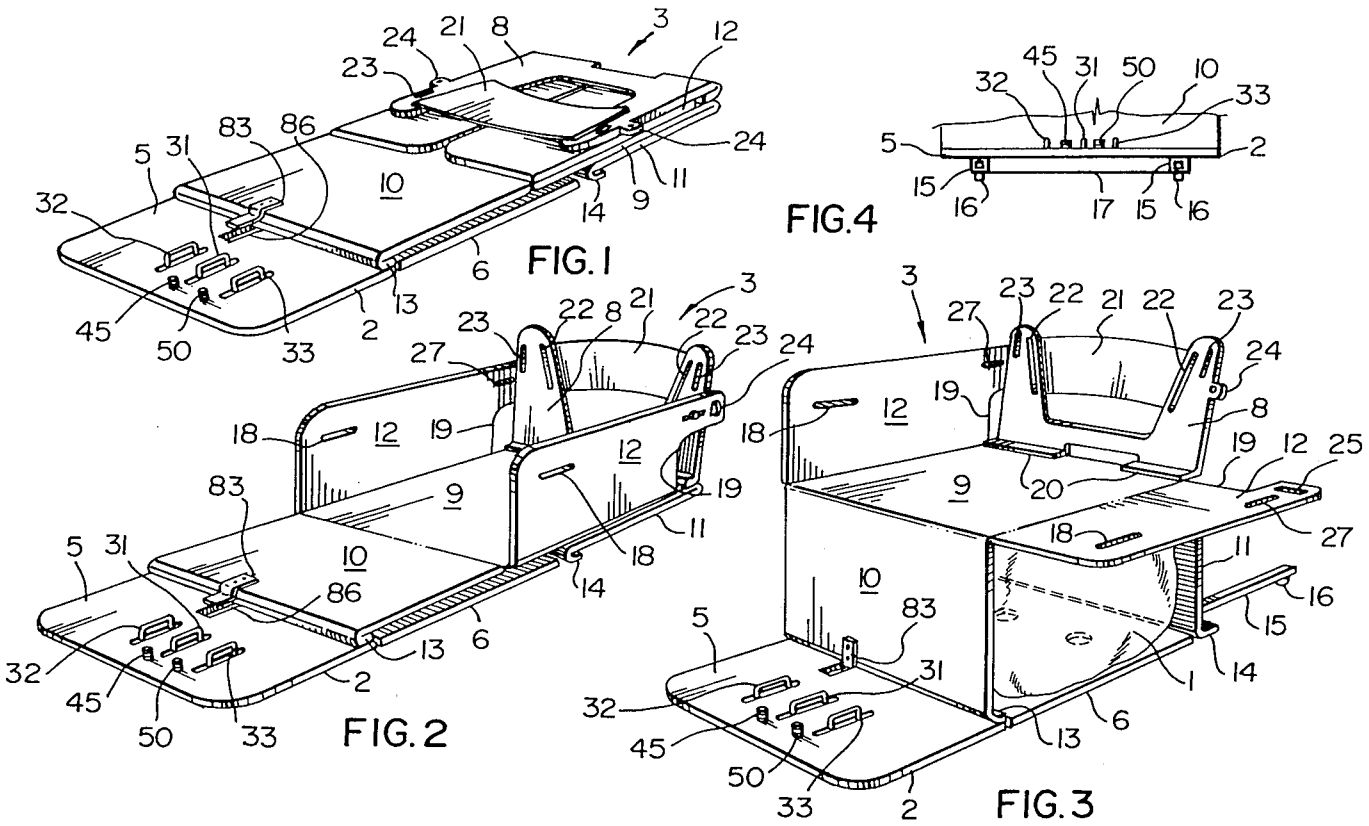
FIG. 1 is a schematic, perspective view of a bath lift device in accordance with the present invention in the flat, storage position.
FIG. 2 is a schematic, perspective view of the bath lift device of FIG. 1 in the lower use position.
FIG. 3 is a schematic, perspective view of the device of FIGS. 1 and 2 in the raised use position.
FIG. 4 is a front view of the bottom portion of the device of FIGS. 1 to 3.

With reference to the drawing, the basic elements of the lift device of the present invention include a plastic bag or bladder 1 which is capable of being inflated by water, a sectional base 2 and a chair generally indicated at 3. The bag 1 (FIG. 3) is thick walled and formed of durable plastic.

The base 2 and the chair 3 are adapted to be folded between the flat or collapsed condition (FIG. 1) and the erected or expanded position (FIG. 3). The base 2 is defined by a planar front panel 5, and a bag supporting, rear panel 6. The chair 3 is defined by a back 8 and a generally cruciform, planar piece of plastic defining a seat 9, front and rear panels 10 and 11, respectively, and sides 12. A flap 13 defining a hinge is provided on the leading edge of the panel 10 for connecting the latter to the front base panel 5. A similar flap or hinge 14 is provided on the trailing edge of the panel 11 for connecting the latter to a pair of parallel, spaced apart, longitudinally extending tracks 15 (FIGS. 3 and 4). The tracks 12, which extend substantially the entire length of the device, are formed of lengths of square aluminum tubing dipped in rubber. Rubber feet 16 are provided at each end of each track 15. The area between the tracks is protected by a plastic sheet 17 (FIG. 4) which covers the plumbing described hereinafter in detail.

The hinges between integral panels 9, 10 and 11, and between the sides 12, the flaps 13 and 14 and the panels are defined by V-shaped grooves in the plastic panels. The same effect can be achieved by using separate panels, sides and flaps, and hinges between such elements.

Figure 5:
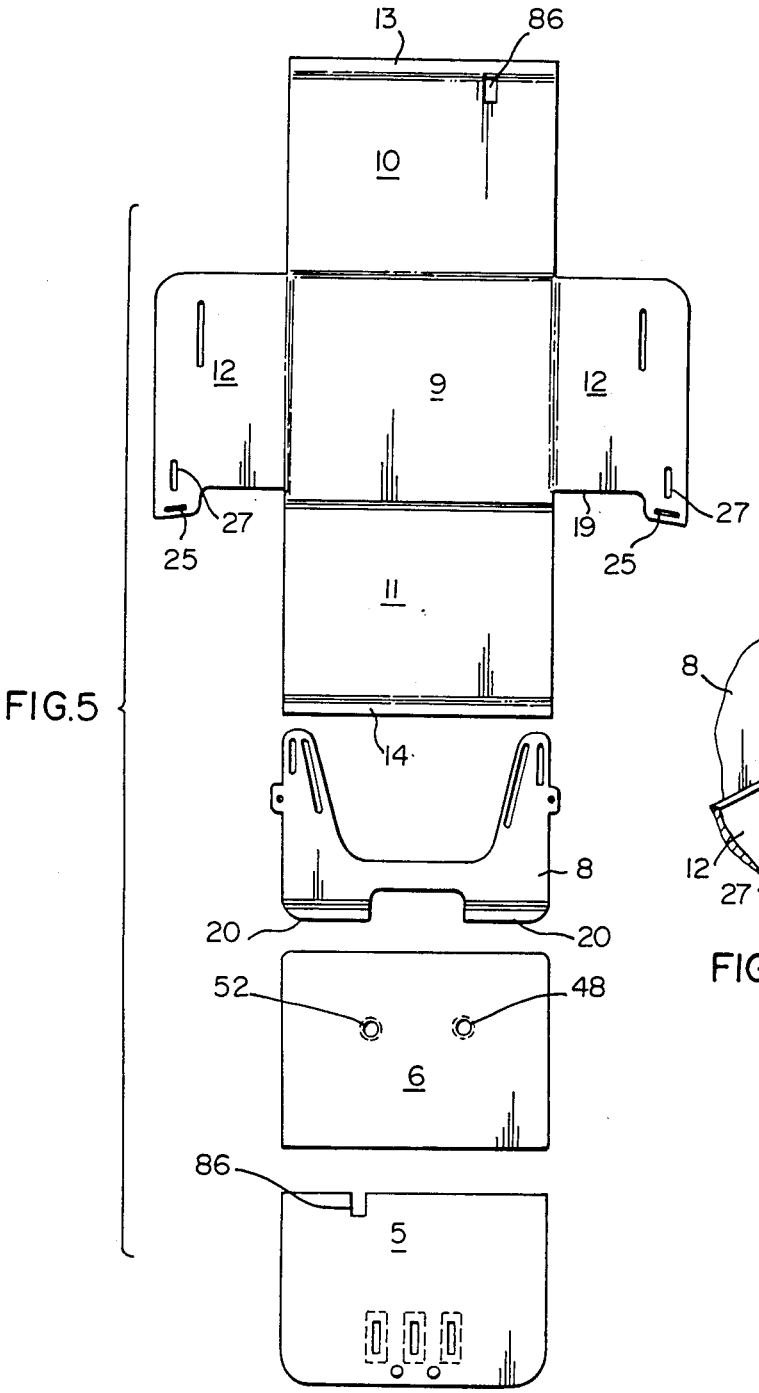
FIG. 5 is an exploded, plan view of the basic elements of the base and chair portions of the device of FIGS. 1 to 3.
Figure 6:
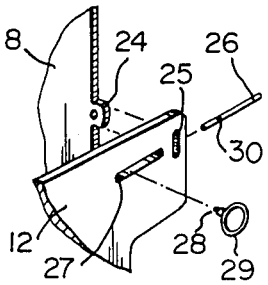
FIG. 6 is an exploded, perspective view of a back and side of the chair portion of the device of FIGS. 1 to 3.

Horizontal slots 18 are provided near the front ends of the sides 12 for receiving a lap restraining or seat belt (not shown). Arcuate notches 19 in the rear ends of the sides 12 are intended to receive a hip restraining belt. The back 8 of the chair 3 is generally U-shaped with a pair of flaps 20 defining hinges connecting the back to the seat 9. Aluminum rivets (not shown) connect the flaps 20 to the seat 9 of the chair. A flexible back support 21 extends between slots 22 in the arms of the back 8. Other slots 23 are provided in such arms for receiving a chest restraining belt (not shown) which holds the user in the chair 3. A lug 24 extends outwardly from each side of the back 8 for connecting the back to a side 12. For such purpose, a slot 25 is provided in each side near the rear end thereof. When the sides 12 are folded from the flat position (FIG. 1), they are first moved beyond the vertical so that the back 8 can be inserted therebetween, and then the sides 12 are moved against the side edges of the back 8 so that the lugs 24 pass through the slots 25. A rod 26 (FIG. 5) is inserted through the rear end of the side 12 and aligned holes in the lug 24 and in the side 12 into a slot 27 in such side 12. The rod 26 is held in position by a bolt 28 extending out of a plastic knob 29 for insertion into a threaded hole 30 in the rod 26.

In order to raise or lower the chair, i.e. to inflate or deflate the bag 1, water must be introduced into or discharged from the bag 1. Two slides 31 and 32 in the front panel 5 of the base 2 are intended to perform such function. A third slide 33 is used to supply water to a hand held shower head (not shown). The slides 31 and 33 (FIGS. 7 and 8) include base plates 35 and 36 respectively, and generally C-shaped soft rubber handles 37. The slides 31 and 33 are mounted in recesses in the front panel 5 of the base 2. The slides 31 and 33 are used to operate ball valves (not shown) in two arms of a Y-shaped coupler 40. Valve operating levers 41 connected to the ball valves extend into notches 42 in the slides 31 and 33. Thus, longitudinal movement of the slide 31 or 33 causes opening or closing of the valves. The slides 31, 32 and 33 can be moved by the users feet. Alternatively, a rod or stick (not shown) with a hook on one end thereof can be used to move the slides 31, 32 and 33.

The stem 44 of the coupler 40 is connected to a tube 45 mounted in the base panel 5, and the tube 45 is connected to a bathtub faucet (not shown). By opening the faucet and operating the slide 31, the corresponding valve in the coupler 40 is opened to feed water through a tube 46 and a tee connector 47 into the bag 1. The connector 47 is mounted beneath the rear base panel 6 and the stem thereof extends upwardlyinto a countersunk opening 48 (FIG. 5) in the panel 6 for feeding water into the bag 1. By operating the slide 33, water is fed through a flexible tube 49 to a tube 50 (FIG. 5) mounted in the base panel 5. The tube 50 is connected to a hand held shower head (not shown).

Figure 7:
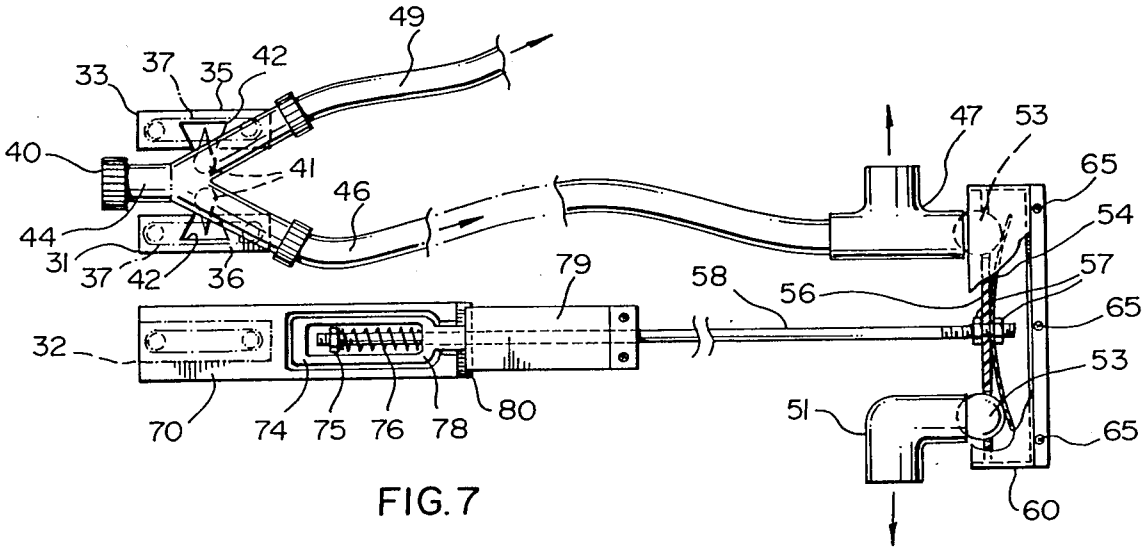
FIG. 7 is a schematic, partly sectioned, bottom view of a control used in the device of FIGS. 1 to 3.
Figure 9:
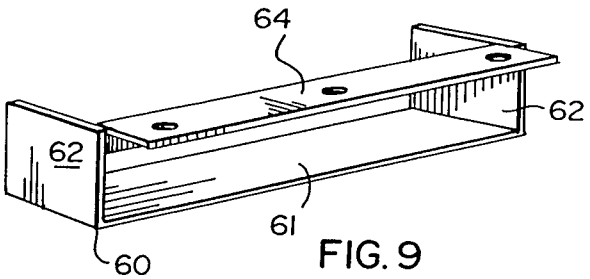
FIG. 9 is a perspective view of a casing used in the control of FIG. 7.
Figure 11:
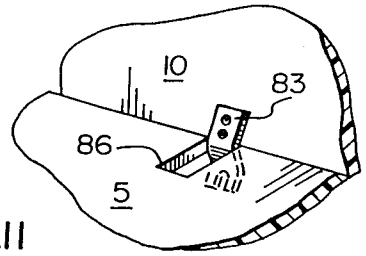
FIG. 11 is a perspective view of a lever used in the release of FIG. 10.
Figure 8:
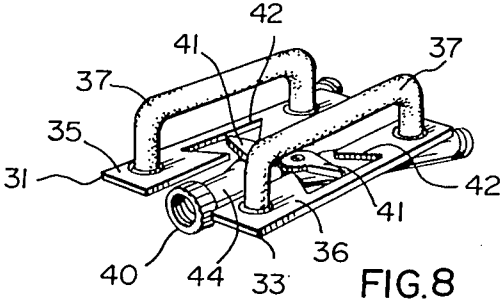
FIG. 8 is a perspective view from above and one end of a pair of slides used in the control of FIG. 7.

The bag 1 is drained, i.e. deflated by discharging water through the connector 47 and an elbow 51. One arm of the elbow 51 extends upwardly through an opening 52 (FIG. 5) in the panel 6 into the bottom of the bag 1, and the other arm of the elbow 51 extends rearwardly. The dishcarge ends of the connector 47 and of the elbow 51 are normally closed by balls 53, which are pressed against the connector 47 and the elbow 51 by a light plastic leaf spring 54. The spring 54 and a slide 56 defined by a strip of plastic are sandwiched between nuts 57 on the rear end of a plastic rod 58. The balls 53, the spring 54 and the slide 56 are housed in a rectangular casing 60 (FIGS. 7 and 9). The casing 60 includes a base 61, and end walls 62 bordering open front and rear ends. The top, rear end of the casing 60 is partially closed by an L-shaped strip 64, which extends between the end walls 62 for receiving screws 65 (FIG. 7) for connecting the casing 60 to the rear base panel 6. Thus, with the water feed valve in the coupler 40 closed, if the slide 32 is moved rearwardly, the balls 53 are caused to move away from the connector 47 and the elbow 51, so that water can be discharged from the bag 1. Any water in the bag 1 exerts sufficient pressure to move the balls 53 to the open position.

Figure 10:
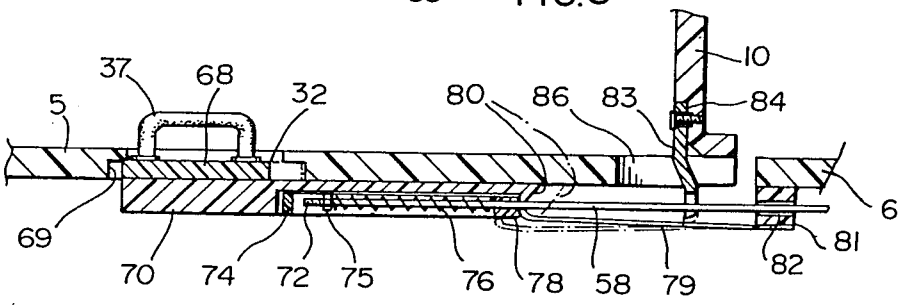
FIG. 10 is a longitudinal sectional view of a safety release used in the device of FIGS. 1 to 3.

As best seen in FIG. 10, the slide 32 includes a base 68 slidable in a slot 69 in the base section 5. The base 68 is connected to a slide block 70, and to the front end 72 of the rod 58. The threaded front end 72 of the rod 58 extends into a bracket 74 (FIGS. 7 and 10), which is slidably mounted in the block 70, i.e. the bracket 74 is free to move a short distance longitudinally in the block 70. A nut 75 is mounted on the threaded front end 72 of the rod 58. A helical compression spring 76 extends between the nut 75 and the inner trailing end 78 of the bracket 74. One end of a plastic leaf spring 79 normally bears against the trailing end of the bracket 74 or against the bevelled trailing end 80 of the slide block 70. The other end of the leaf spring 79 is attached to a block 81, which is mounted on the rear base panel 6. A hole 82 extends through the block 81 permitting sliding of the rod 58 through such block 81. The leaf spring 79 can be dislodged by a bifurcated lever 83, which is mounted in a recess 84 in the front panel 10 of the chair. The lever 83 extends downwardly through a notch 86 in the rear edge of the front base panel 5. During normal operation, the slide 32 and consequently the slide block 70 are pushed forward and the spring 79 moves into position abutting the bevelled trailing end 80 of the slide block 70. The bracket 74 remains stationery, i.e. trails the block 70, so that the spring 76 is placed under tension, i.e. compressed between the nut 75 and the inner trailing end of the bracket 74. If too much water enters the bag 1, the lever 83 presses downwardly against the spring 79 to release the slide block 70. Thus, the slide block 70 is free to move rearwardly to release the balls 53. The pressure of the water in the bag 1 causes draining thereof. Incoming water is diverted through the discharge arm of the tee connector 47 and some water escapes from the bag through the elbow 51. As soon as sufficient water has escaped, the slide 33 and the block 70 can be returned to the forward position. Of course, the valve in the coupler 40 operated by slide 31 is also closed to stop overfilling of the bag while draining of excess water is being effected.

When not in use, the device can be stored in the folded, flat condition (FIG. 1). In the first use position, (FIG. 2) the sides 12 and back 8 of the seat 3 are locked in the vertical position by erecting first the back 8 and then the sides 12, and inserting and locking the lugs 24 in the slots 25. By moving the slide 31, the appropriate valve is opened to fill the bag 1, thus raising the seat 3 parallelogram-fashion to the second use position (FIG. 3). The slide 32 actuates the hand shower (not shown), and the slide 33 initiates emptying of the bag 1, i.e. lowering of the seat 3 to the first use position. Of course, if the bathtub is filled with water, the seat 3 is first elevated to receive the user, and then lowered to place the user in the water. In order to initiate bag emptying the slide 33 and the slide block 70 are moved rearwardly so that the front end of the spring 79 rides down over the bevelled trailing end 80 of the slide block 70.

I claim:

1. A bath lift device comprising planar base means for use on the bottom of a bathtub; chair means hingedly connected to said base means; fluid inflatable bag means in said chair means for inflation to raise the chair to an upper, elevated position and for deflation for lowering the chair to a lower, flat position, first valve means for controlling the flow of fluid to said bag means; second valve means for controlling the discharge of fluid from said bag means; and slide means in said base means for controlling said first and second valve means.

2. A device according to claim 1, wherein said chair means includes front wall means; rear wall means parallel to and spaced apart from said front wall means; and seat means, one end of each said front and rear wall means hingedly connected to said base means and the other end thereof hingedly connected to said seat means, whereby the chair means can be raised or lowered parallelogram-fashion.

3. A device according to claim 2, including hinge means connecting said front and rear wall means to said base means and to said seat means.

4. A device according to claim 3, wherein said hinge means is integral with said front and rear wall means and with said seat means.

5. A device according to claim 4, wherein said hinge means includes flaps for connecting said front and rear wall means to said base means; and first grooves extending transversely between said flaps and said front and rear wall means, and transversely between said seat means and said front and rear wall means.

6. A device according to claim 5, wherein said chair means includes a back pivotally connected to the rear edge of said seat means, and sides pivotally connected to the side edges of said seat means, whereby the chair means can be folded flat on said base means to a non-use position and unfolded to a use position.

7. A device according to claim 5, wherein said sides are integral with said seat means.

8. A device according to claim 7, including second grooves extending between said sides and said seat means defining hinges.

9. A device according to claim 1, including latch means for releasably locking said second valve means in a closed position, whereby positive release of said latch means by said second slide means is required to open said second valve means.

10. A device according to claim 9, including safety release means for releasing said latch means in the event of overfilling of said bag means.

11. A device according to claim 1, wherein said slide means includes a first slide for controlling operation of said first valve means; and a second slide for controlling operation of said second valve means.

12. A device according to claim 11, including third valve means for feeding water to a hand shower; and third slide means in said base means for controlling operation of said third valve means.

* * * * *